US005571140A

United States Patent [19]

Gura-Emerling

[11] Patent Number: 5,571,140

[45] Date of Patent: Nov. 5, 1996

[54] INFANT TEETHER AND TRAINING TOOTHBRUSH

[76] Inventor: Mary F. Gura-Emerling, 405 Good Hope Cemetery Rd., Oak Grove, Ky. 42262

[21] Appl. No.: 488,754

[22] Filed: Jun. 5, 1995

[51] Int. Cl.[6] ..... A61J 17/00

[52] U.S. Cl. ..... 606/236; 15/167.1

[58] Field of Search ..... 15/167.1, 110; 606/234–236; D24/194–199; D4/104–109; D6/524

[56] References Cited

U.S. PATENT DOCUMENTS

| | | | |
|---|---|---|---|
| D. 290,655 | 6/1987 | Thomson et al. . | |
| 1,593,763 | 7/1926 | Henderson | 15/167.1 |
| 3,669,117 | 6/1972 | Hanbst . | |
| 4,035,865 | 7/1977 | McRae et al. | 15/167.1 |
| 5,058,230 | 10/1991 | Hodosh et al. | 15/167.1 |
| 5,059,215 | 10/1991 | Girau | 606/234 |
| 5,197,974 | 3/1993 | Scarpelli et al. | 606/235 |

FOREIGN PATENT DOCUMENTS

| | | | |
|---|---|---|---|
| 0555901 | 11/1958 | Italy | 606/234 |

*Primary Examiner*—Glenn Dawson
*Attorney, Agent, or Firm*—John D. Gugliotta

[57] ABSTRACT

An infant teether and cleaning toothbrush includes an oversized hollow rubber body that allows easy grip for small infants. The rubber body has an internal hollow space to allow the addition of rattle noise making bell or music making devices to increase the infants auditory stimulus. The exterior surface of the rubber body has raised ridges to provide better grip for a small infant. The generally round rubber body has an elongated neck protruding on one end which is capped with a receptor and safety lock device. Two attachable extensions are provided; one is a toothbrush unit having a brush end and a connection end which fits into the receptor. The other attachable extension is a teething unit made of durable rubber having a shaft with a connection end, and a teething end, provided with bumps simulating the toothbrush bristles providing the infant with a teething structure. Both the teething unit and the toothbrush unit are replaceable and disposable, thereby allowing the transition from teether to toothbrush, as well as providing improved hygiene.

4 Claims, 4 Drawing Sheets

INFANT TEETHER AND TRAINING TOOTHBRUSH

BACKGROUND OF THE INVENTION

1. Field of the Invention

The present invention relates generally to infant teether devices and, more particularly, to an infant teether device with inter-changeable teether and toothbrush components such as to be utilized both as a teether and as a training toothbrush.

2. Description of the Related Art

In the related art, many infant teether devices are known. For example, U.S. Pat. No. 5,197,974 issued in the name of Scarpelli et al., a pacifier apparatus with heating or cooling capabilities is disclosed. The device disclosed in the Scarpelli et al. reference comprises essentially a nipple member containing a fluid, permitting heating or chilling of the nipple member to accommodate various applications for use with an infant. Also disclosed in the Scarpelli et al., reference is a design wherein a musical rattle is incorporated with the pacifier. Although the ability to use such a devise as a teether apparatus is apparent, nothing is disclosed as to any function in the future that would allow such an invention to be utilized as a toothbrush trainer.

Also in U.S. Pat. No. 5,059,215 issued in the name of Girau, an infant rattler and a teething kit is disclosed. As disclosed in the Girau reference, what is essentially a pacifier unit attached to a rattle member is described comprising essentially a multi-compartmented nipple affixed to a standard pacifier configuration.

Additionally, in U.S. Pat. No. 3,669,117 issued in the name of Herbst, a combination teether and pacifier is disclosed. A combination teether and pacifier disclosed in the Herbst reference comprises a thin walled, flexible body having a nipple and a guard on one end, and a teether portion on the other end. The entire apparatus is hollow, and the nipple end is in communication with the teether end. The hollow void is also filled with fluid allowing it to be heated or cooled.

Finally, known to the inventor is a combined toy teether and rattle toy disclosed in U.S. Pat. No. Des. 290,655 issued in the name of Thomson et al. wherein an ornamental design combines toy teether and rattler toy is show and described.

Although all the above references described designs which can function as infant teethers, none of the above references discloses an apparatus that can allow an infant to make a transition from teether to toothbrush, or that can operate as a training toothbrush as well as an infant teether. Consequently, the need has now been felt for providing such an apparatus, such need being fulfilled by the present invention herein.

SUMMARY OF THE INVENTION

It is therefore an object of the present invention to provide a combination infant teether and training toothbrush.

It is an object of the present invention to provide an improved infant teether and training toothbrush having disposable, replaceable components.

It is another object of the present invention to provide an infant teether and training toothbrush additionally having a toy-like musical feature.

It is yet another object of the present invention to provide an improved infant teether that can aid an infant in making the transition from teething to further proper oral hygiene.

It is a feature of the present invention to provide an infant teether and training toothbrush detachable, disposable teether and toothbrush attachments.

In accordance with the preferred embodiment of the present invention, an infant teether and cleaning toothbrush is disclosed comprising an oversized hollow rubber body that allows easy grip for small infants. The rubber body has an internal hollow space to allow the addition of rattle noise making bell or music making devices to increase the infants auditory stimulus. The exterior surface of the rubber body has raised ridges to provide better grip for a small infant. The otherwise generally round rubber body has a narrow, elongated neck protruding on one end. This elongated neck is capped with a receptor and safety lock device. In this preferred embodiment, two attachable extensions are provided; one is a toothbrush unit having a brush end and a connection end which fits into the receptor, locking safely in place to prevent disengagement which may lead to a possible choking hazard. The other attachable extension is a teething unit made of durable rubber having a shaft with a connection end and a teething end, the teething end being provided with bumps simulating the toothbrush bristles and thereby providing the infant with a teething structure. Both the teething unit and the toothbrush unit are replaceable and disposable, thereby allowing the transition from teether to toothbrush, as well as providing improved hygiene. The rubber body acts as an oversized handle, which provides the safety feature of preventing the choking that could occur with a standard toothbrush if used by an infant.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
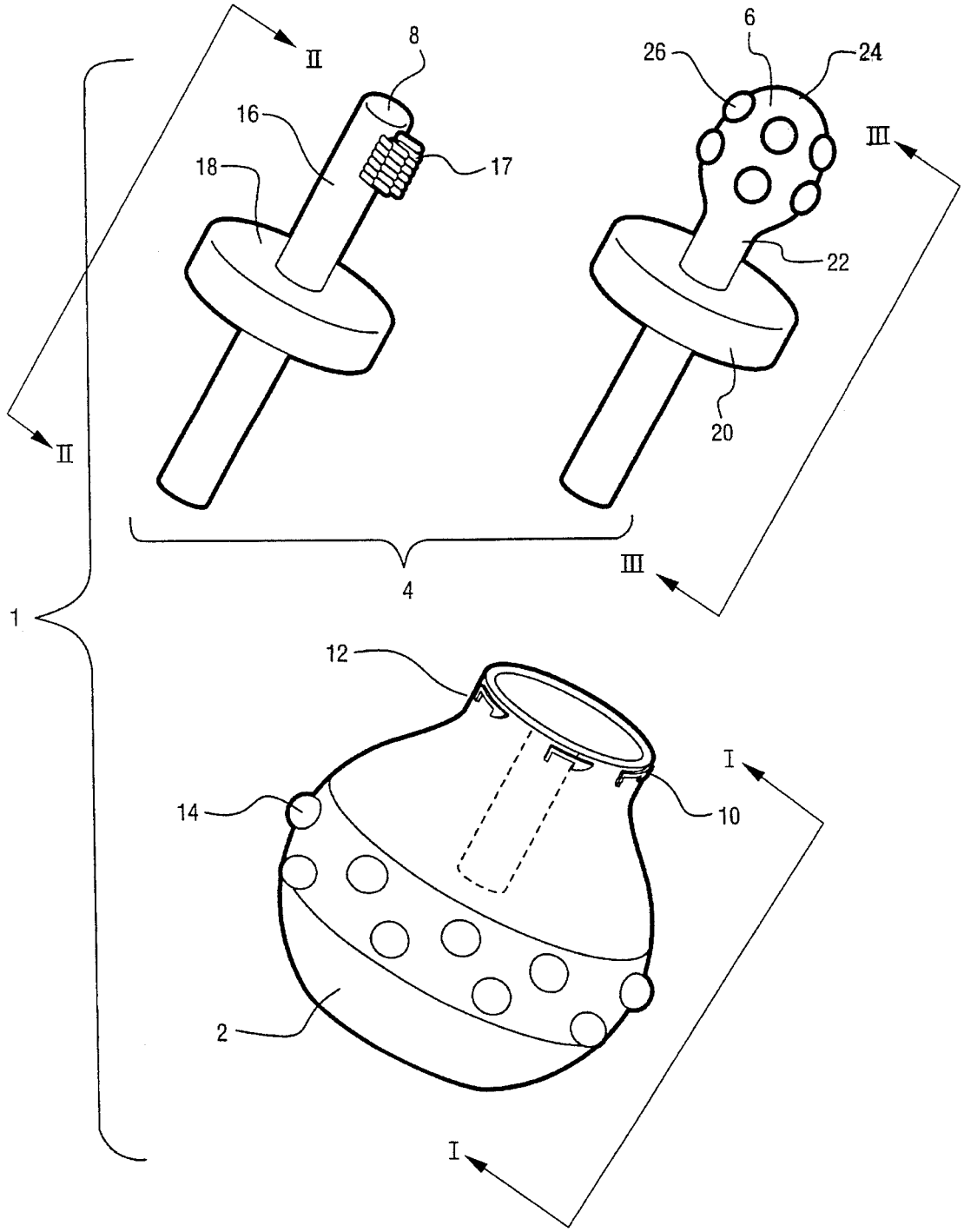
FIG. 1 is an orthographic view of an infant teether and training toothbrush described according to the preferred embodiment of the present invention.

Referring now to FIG. 1, a combination Infant Teether and Training Toothbrush 1 is disclosed according to the present invention, comprising a rubber body 2 and a pair of attachable extensions 4. The pair of attachable extensions 4 comprise at least one teether unit 6, and one toothbrush unit 8. The rubber body 2 has a receptor and safety lock 10 located at the end of an elongated neck section 12. The surface of the rubber body 2 also has raised ridges 14.

Referring to the attachable extensions 4, the toothbrush unit 8 has a brush end 16 with bristles 17, and a first connection end 18 that fittingly engages and covers the receptor and safety lock 10 of the elongated neck section 12 of the rubber body 2. The teether unit 6 has a second connection end 20, identical in function as the first connection end 18 of the toothbrush unit 8. The teether unit 6 has a shaft 22 extending outward from the second connection end 20, terminating in a bulbus teether end 24. The teether end 24 is circumscribed with bumps 26, which provide a teething structure.

Figure 2:
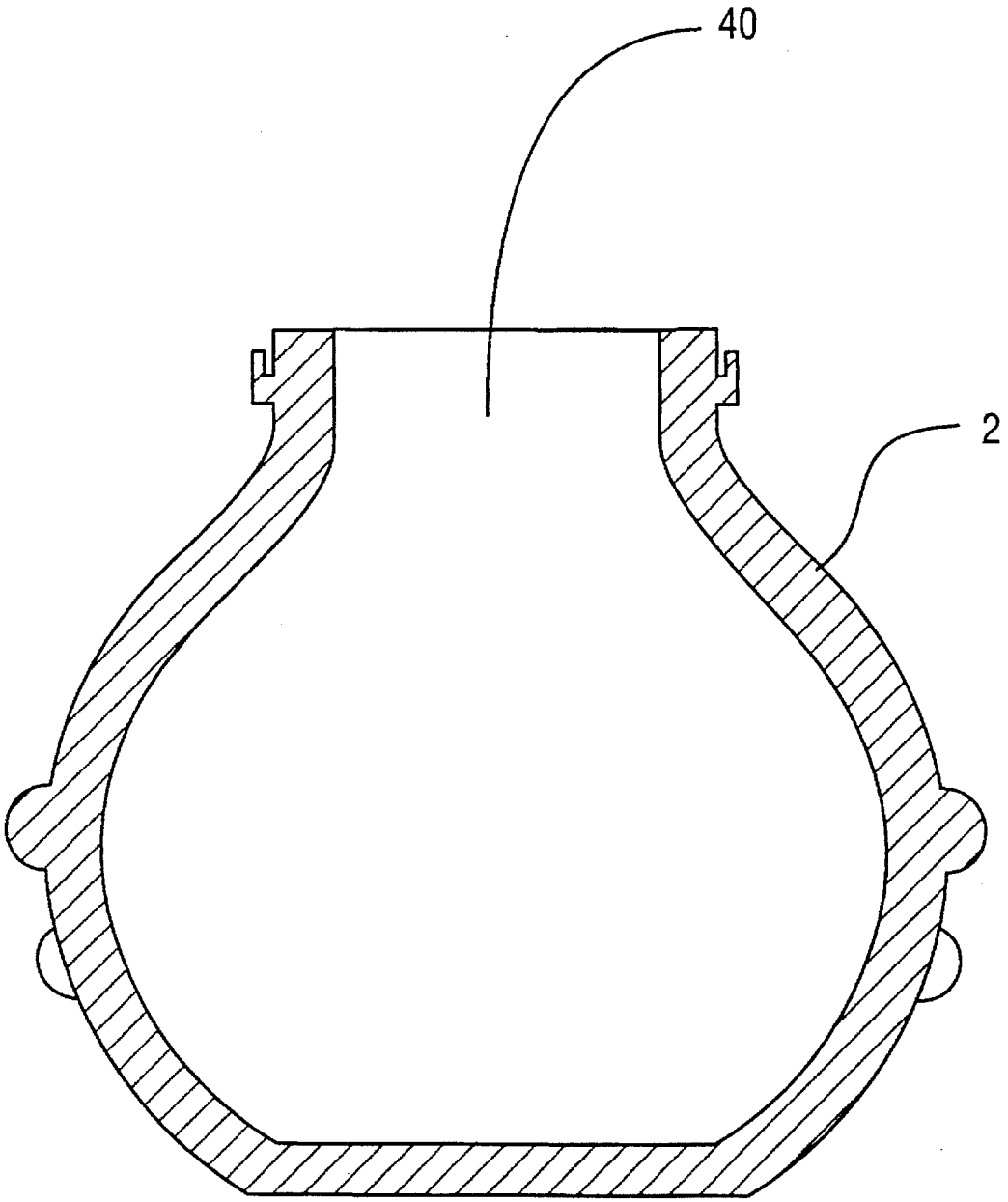
FIG. 2 is a cross-sectional view of the oversized, hollow rubber body used as the handle section of the infant teether as described in FIG. 1, taken along the lines I—I in FIG. 1.

Referring now to FIG. 2, the details of the rubber body 2 are more clearly shown. According to the preferred embodiment of the present invention, the rubber body widest point has a circumference of about approximately 6 inches and the elongated neck 12 is approximately 3" in length from the center of the rubber body 2. According to these preferred dimensions, the rubber body 2 will act as a bulb-like handle, allowing small hands to firmly grasp the device, while also preventing choking at the same time. The attachable extensions 4 screw onto the rubber body 2 with a child safety cap type connection means. Although it is currently envisioned that other attachment locking means may function effectively, it is presently felt that an attachment means such as the locking devices currently utilized for pharmaceutical child safety caps provides the necessary safety and functionality. Finally, the rubber body 2 forms a hollow internal space 40, which allows for the introduction of a variety of rattle, music, or noise making devices, such as bells, to increase an infants auditory stimulus while utilizing the present invention.

Figure 3:
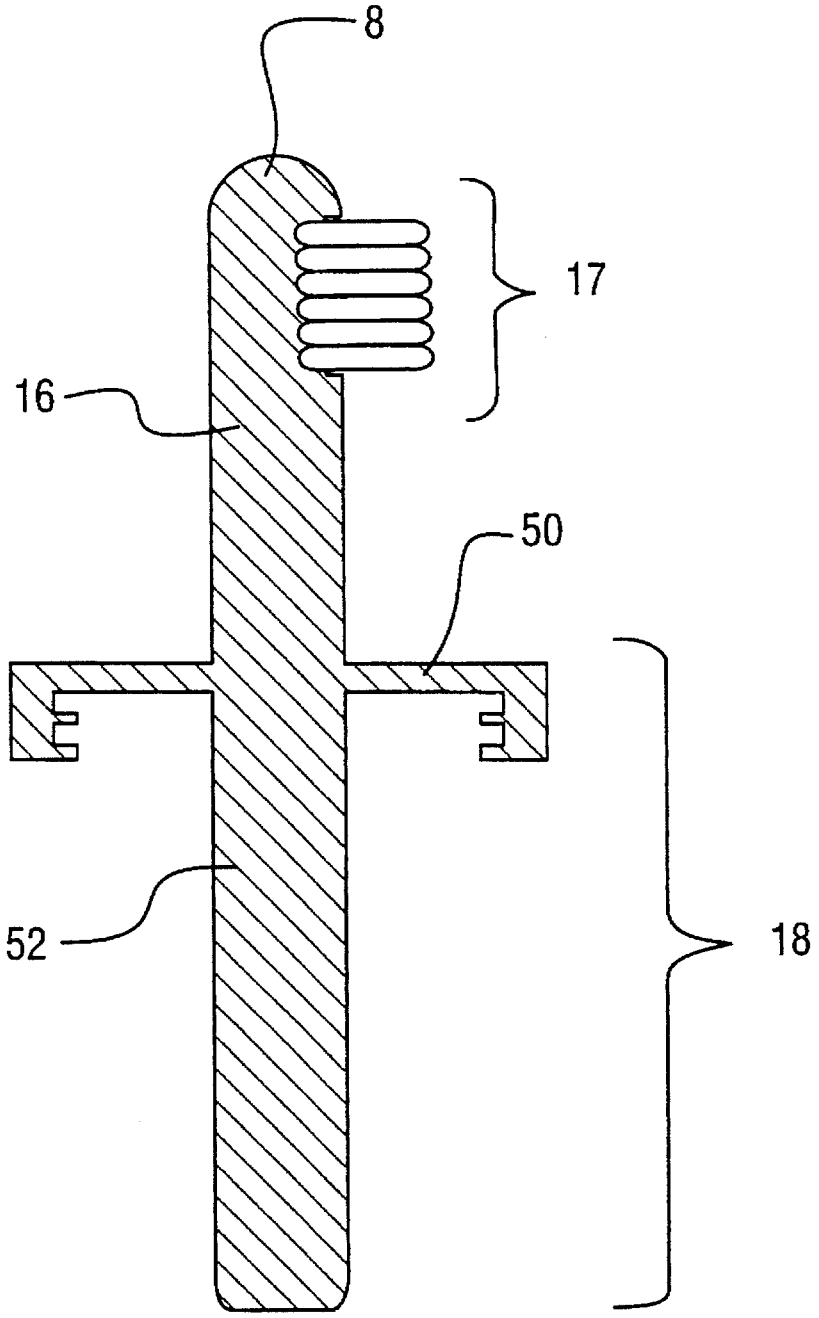
FIG. 3 is a cross-sectional view of the toothbrush unit attachable extension for use with the infant teether as described in FIG. 1, taken along the lines II—II in FIG. 1.

In FIG. 3, the toothbrush unit 8 is shown. The brush end 16 has bristles 17 attached. In its preferred embodiment, the first connection end 18 is comprised of a screw cap 50 which fits over and engages with the receptor and safety lock 10 of the rubber body 2. The brush end 16 protrudes outward, and an first internal insertion end 52 aids in exciting any bells, rattles, noisemakers, or the like that are inserted into the internal hollow space (40, in FIG. 2).

Figure 4:
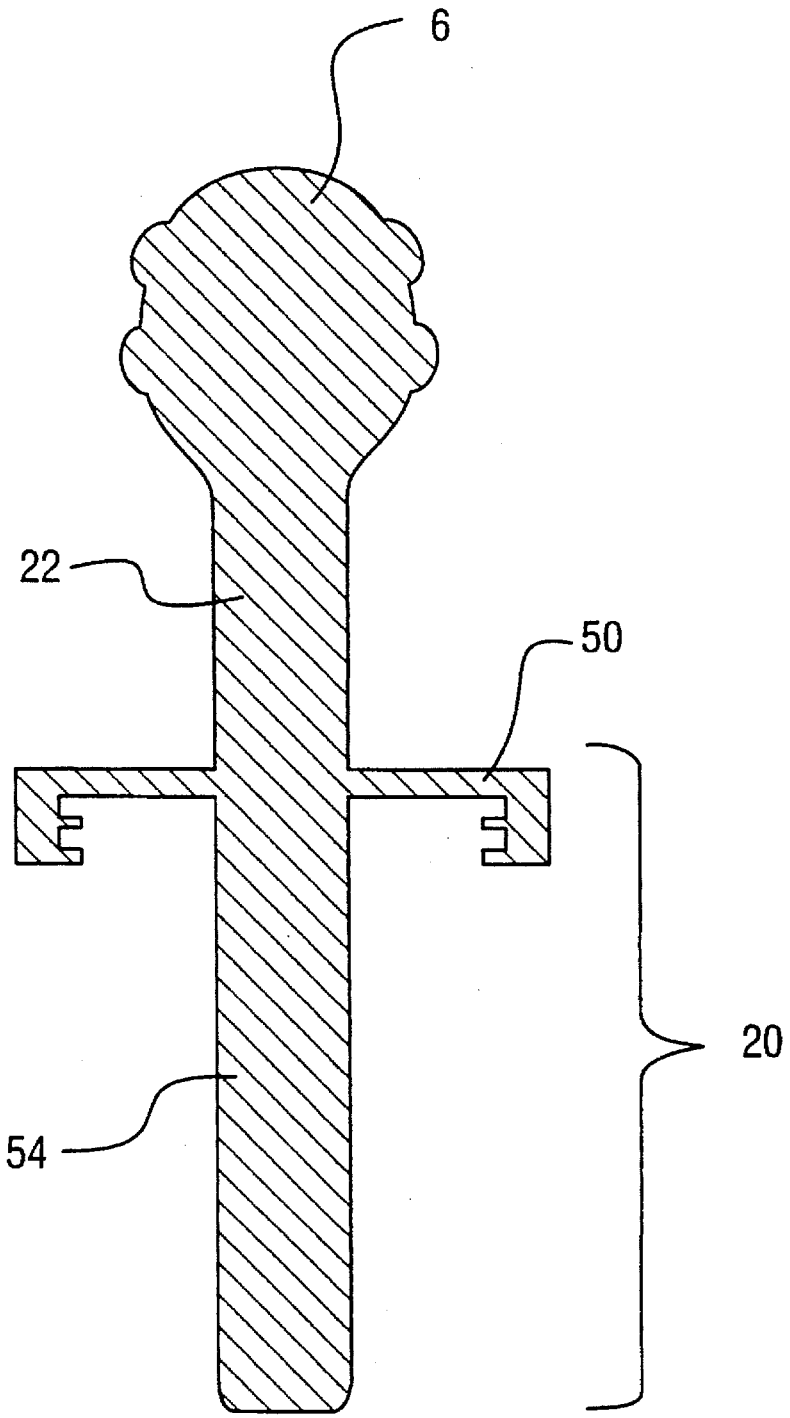
FIG. 4 is a cross-sectional view of the teether unit attachable extension for use with the infant teether as described in FIG. 1, taken along the lines of III—III in FIG. 1.

In FIG. 4, a teether unit 6 is shown of similar construction to the toothbrush unit 8. In its preferred embodiment, a screw cap 50, identical to that of the toothbrush unit 8, would comprise the second connection end 20. A shaft 22 would protrude outward, and a second internal insertion end 54, identical to the first internal insertion end 52, aids in exciting any bells, rattles, noisemakers, or the like that are inserted into the internal hollow space (40, in FIG. 2).

2. Operation of the Preferred Embodiment

To utilize the present invention, a parent would insert the teether unit 6 into the rubber body 2. At this point, an infant is permitted to play with and teeth with the device. As the infant grows and has teeth which begin to appear, at the parent's discretion the teether unit 6 will be replaced by a toothbrush unit 8. The infant is already familiar with the device with teether insert will now be introduced to a toothbrush which is similar in function to that which he sees his or her parents utilizing. The ability to interchange the attachable extensions 4 also allow not only for adaptability, but also improved hygiene in that teether or toothbrush system can be replaced, disposed, or cleaned on a regular basis. It is also currently envisioned that the present invention is easily adapted to be utilized by adults suffering from handicap or illness such as arthritis, which may impair their ability to grasp firmly the standard, thin toothbrush handle.

The foregoing description of the preferred embodiment of the present invention has been presented for purposes of illustration and description. It is not intended to be exhausted or to limit the present invention to the precise form disclosed and obviously many modifications and variations are possible in light of the above teachings.

While a preferred embodiment of the present invention has been shown and described, it will be understood that it is not intended to limit the disclosure, but rather it is intended to cover all modifications and alternate constructions falling within the spirit and scope of the invention as defined in the appended claims.

What is claimed is:

1. A combination infant teether and training toothbrush comprising:

a bulbus, generally round handle, said handle having narrowed, elongated neck;

at least one first attachable extension, said first attachable extension comprising a toothbrush unit having a first connection means for connecting said toothbrush unit to said elongated neck; and at least one second attachable extension, said second attachable extension comprising a bulbus teether unit having a second connection means for connecting said teether unit to said elongated neck wherein said second attachable extension further comprises a generally elongated shaft attached at a teether end to said teething unit, said teether unit further containing a series of protuberances extending therefrom.

2. The combination infant teether and training toothbrush as described in claim 1, wherein said bulbus, generally round handle further comprises a hollow rubber body having an internal hollow space and having an outer surface, said outer surface being punctuated with raised, grippable ridges, and wherein said elongated neck further comprises a receptor and locking means for alternately receiving either the first attachable extension or the second attachable extension interchangeably via a screw-on, child resistant lock.

3. The combination infant teether and training toothbrush as described in claim 1, further comprising a locking means for latching either attachable extension in a conventional, screw-action manner resistant to disengagement by small children.

4. The combination infant teether and training toothbrush as described in claim 1, wherein said bulbus, generally round handle further comprises a hollow rubber body having an internal hollow space, said body further comprising a noise-making device moveably incorporated within said internal hollow space.

* * * * *